US005753147A

United States Patent [19]

Hudz

[11] Patent Number: 5,753,147

[45] Date of Patent: May 19, 1998

[54] FUEL DELIVERY APPARATUS

[75] Inventor: Paul H. Hudz, Redding, Calif.

[73] Assignee: Inverness Family Trust, Rarotonga, Cook Islands

[21] Appl. No.: 752,001

[22] Filed: Nov. 15, 1996

Related U.S. Application Data

[63] Continuation-in-part of Ser. No. 543,111, Oct. 13, 1995, abandoned.

[51] Int. Cl.[6] ..... F02M 9/08

[52] U.S. Cl. ..... 261/44.2; 261/79.1

[58] Field of Search ..... 261/44.2, 79.1

[56] References Cited

U.S. PATENT DOCUMENTS

| | | | |
|---|---|---|---|
| 1,753,009 | 4/1930 | Hess | 261/79.1 |
| 3,048,378 | 8/1962 | Newman, Sr. | 261/79.1 |
| 3,202,404 | 8/1965 | Brandwood et al. | 261/44.2 |
| 3,220,709 | 11/1965 | Pickron et al. | 261/44.2 |
| 4,232,645 | 11/1980 | Shiber | 261/79.1 |
| 5,171,487 | 12/1992 | Hudz | 261/79.1 |

FOREIGN PATENT DOCUMENTS

| | | | |
|---|---|---|---|
| 421649 | 2/1911 | France | 261/44.2 |

*Primary Examiner*—Tim R. Miles

*Attorney, Agent, or Firm*—Meschkow & Gresham, P.L.C.; Jordan M. Meschkow; Lowell W. Gresham

[57] ABSTRACT

A fuel delivery system for use with an internal combustion engine includes a fuel delivery device such as a carburetor 12, or a throttle body or port fuel injection fuel regulator 16, a fuel vaporizer 14 that provides the carburetor 12 with vaporized fuel, a fuel regulator 16 that regulates fluid characteristics of the fuel, and an electronic control module 18 that controls the fuel regulator 16. The fuel delivery device includes a body 22 having an inlet port 28 and an outlet port 30 and a throttle valve assembly 24 that regulates the air stream flowing through the body 22. The throttle valve assembly 24 is adapted to induce a vortex in the air stream, and to release vaporized fuel into the center of the vortex. An actuating mechanism 46 causes two vanes 42 and 44 to rotate in opposite directions, which induces the vortex.

19 Claims, 5 Drawing Sheets

FUEL DELIVERY APPARATUS

CROSS REFERENCE TO RELATED APPLICATION

This application is a continuation-in-part to Ser. No. 08/543,111, filed Oct. 13, 1995, now abandoned.

TECHNICAL FIELD OF THE INVENTION

The present invention relates generally to fuel intake systems. More particularly, the present invention relates to intake throttle valves.

Background of the Invention

Conventional carburetors, and throttle body and port fuel injection systems designed for internal combustion engines typically include a throttle valve to regulate the air/fuel mixture flow. A throttle valve is typically configured as a solid flat disk that rotates about a diametrical axis within the body of a carburetor or other fuel delivery apparatus. Throttle valves can vary between a fully closed position (minimum air flow) and a fully open position (maximum air flow). The air/fuel mixture that flows past the throttle valve is eventually burned by the internal combustion engine.

An internal combustion engine operates efficiently and cleanly when the air and fuel is delivered as a homogenized and lean mixture. For example, higher gas mileage, cooler operating temperatures, and reduced exhaust emissions may be realized if an automobile engine utilizes the minimum amount of gasoline in the air/fuel mixture. Conventional throttle valves merely function as a flow restrictor for whatever air/fuel mixture is present in the carburetor. Such valves do nothing to enhance or alter the air/fuel mixture or the flow of the passing air stream.

Internal combustion engines typically operate less efficiently at lower throttle settings than at higher throttle settings. This is due in part to the velocity of the air/fuel mixture that enters the combustion chambers. Because the air stream velocity is proportional to the throttle setting, the air and fuel do not form a fully homogenized mixture at lower throttle settings. Conventional throttle valve assemblies are not designed to compensate for this lack of efficiency at lower throttle settings.

The above and other advantages of the present invention are carried out in one form by a throttle valve assembly having a first rod, a second rod, a first vane coupled to the first rod, and a second vane coupled to the second rod. The throttle valve assembly is configured to induce turbulence in an induction air stream.

SUMMARY OF THE INVENTION

Accordingly, it is an advantage of the present invention that an improved throttle valve assembly is provided.

Another advantage of the present invention is that it provides a throttle valve that functions to homogenize an air/fuel mixture flow.

A further advantage is that a throttle valve is provided that compensates for the unsatisfactory operating efficiency of an internal combustion engine at lower throttle settings.

Another advantage is that the utilization of a throttle valve according to the present invention in an internal combustion engine reduces fuel consumption and exhaust emissions.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
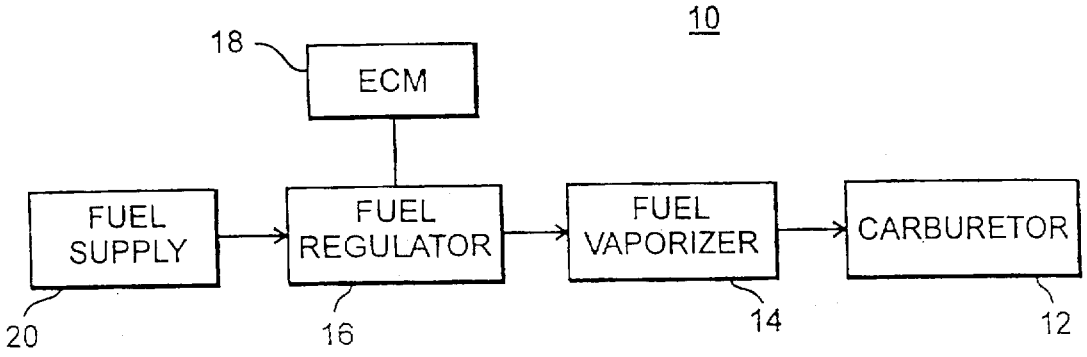
FIG. 1 is a schematic representation of a fuel delivery system for use with an internal combustion engine.

Referring to FIG. 1, a schematic representation of a fuel delivery system 10 according to the present invention is illustrated. System 10 is preferably utilized in conjunction with a conventional internal combustion engine (not shown), such as an automobile engine. System 10 generally includes a carburetor 12, a fuel vaporizer 14, a fuel regulator 16, an electronic control module (ECM) 18, and a fuel supply 20. System 10 provides an air/fuel mixture to the engine in a preferred manner that increases the fuel efficiency of the engine.

Carburetor 12 regulates the air/fuel mixture and responds to the throttle setting of the driver. Those skilled in the art will recognize that carburetor 12 may instead be a throttle body element, a port fuel injection assembly, or other equivalent component known to those skilled in this art. Thus, for purposes of the present description, "carburetor" refers to any component configured to deliver an air/fuel mixture to a combustion chamber of an engine. Carburetor 12 will be described in detail below.

Fuel vaporizer 14 is in fluid communication with carburetor 12, via a fuel line, hose, or other suitable connector. Fuel vaporizer 14 provides vaporized fuel to carburetor 12, where the vaporized fuel is mixed with air in preparation for combustion. Fuel vaporizers are well known to those skilled in the art, and will not be described in detail herein. Fuel vaporizer 14 is preferably utilized to allow carburetor 12 to produce a substantially homogenized air/fuel mixture. Those familiar with fuel delivery systems will appreciate that although the preferred embodiment includes fuel vaporizer 14, nothing prevents the present invention from alternatively utilizing conventional carburetor components such as fuel jets, diaphragms, and the like.

Fuel vaporizer 14 is preferably also connected to fuel regulator 16. Fuel regulator 16 is adapted to receive fuel from fuel supply 20 and to regulate the fluid characteristics of the fuel. For example, fuel regulator 16 may regulate the pressure, flow rate, or flow volume of the fuel. Thus, fuel regulator 16 may be utilized to ensure that the engine operates in a fuel efficient manner by metering the amount of gasoline consumed by the engine. Fuel regulators that perform the functions described above are well known to those skilled in the art.

To ensure that the engine is operating properly, system 10 preferably includes ECM 18, which is electronically connected to fuel regulator 16. Of course, ECM 18 may also be connected to other components of the engine to monitor any number of operating functions. For purposes of the present invention, ECM 18 is utilized to control fuel regulator 16 such that the engine receives a lean and homogenized air/fuel mixture from carburetor 12. ECM 18 may react to signals sent by various sensors (not shown) to provide feedback control to fuel regulator 16.

Figure 2:
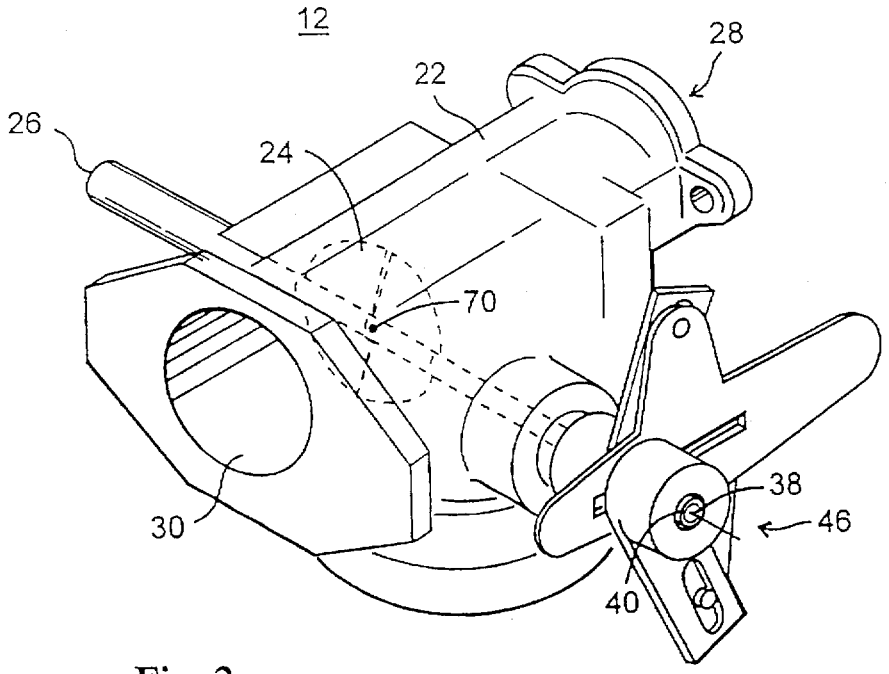
FIG. 2 is a perspective view of a carburetor according to the present invention.

With reference now to FIG. 2, carburetor 12 is shown in detail. As stated above, carburetor 12 mixes the vaporized fuel with an induction air stream in preparation for combustion. Briefly, carburetor 12 includes a body 22, a throttle valve assembly 24, and a fuel inlet 26. For the sake of clarity and brevity, conventional operating components and features of carburetor 12 unimportant to the present invention are not shown in FIG. 2 or described herein.

Body 22 includes an inlet port 28 and an outlet port 30 formed therein. Inlet port 28 receives an incoming stream of air, which is regulated by throttle valve assembly 24. Throttle valve assembly 24 is adapted to vary between a fully closed position, which substantially restricts the air stream through body 22, and a fully open position, which allows the maximum air flow through body 22. Throttle valve assembly 24 is described in more detail below.

Fuel inlet 26 provides fuel to carburetor 12. According to the preferred embodiment, fuel inlet 26 is in fluid communication with fuel vaporizer 14 (see FIG. 1). As stated above, the present invention need not utilize fuel vaporizer 14, and fuel inlet 26 may instead be connected directly to fuel regulator 16. According to a preferred aspect of the present invention, fuel inlet 26 is integral to throttle valve assembly 24. This configuration is desirable to allow the fuel to be released in a substantially central position relative to the air stream flowing through body 22 (described below).

Carburetor 12 is configured such that turbulence is induced in the air/fuel mixture when throttle valve assembly 24 is in an open position. Although a separate turbulence-inducing element may be employed by carburetor 12, the preferred embodiment is configured such that throttle valve assembly 24 itself induces turbulence in the air stream. The turbulence effect is realized in the form of a vortex, i.e., throttle valve assembly 24 swirls the air/fuel mixture as it flows through body 22.

Figure 3:
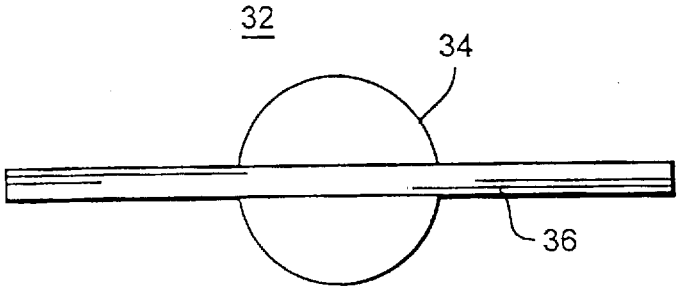
FIG. 3 is a front view of a throttle valve assembly according to the prior art.

FIG. 3 shows a prior art throttle valve 32, and FIGS. 4–12 show throttle valve assembly 24, which is adapted to induce a vortex in the passing air/fuel mixture. Prior art throttle valve 32 includes a vane 34 and an actuating rod 36. Briefly, rotation of actuating rod 36 causes vane 34 to open or close, which regulates the flow of air and fuel to the engine. Fuel is sprayed or injected at a point removed from vane 34, typically within an intake port (not shown). Vane 34 is a solid, one-piece element that rotates according to the rotation of actuating rod 36.

Figure 4:
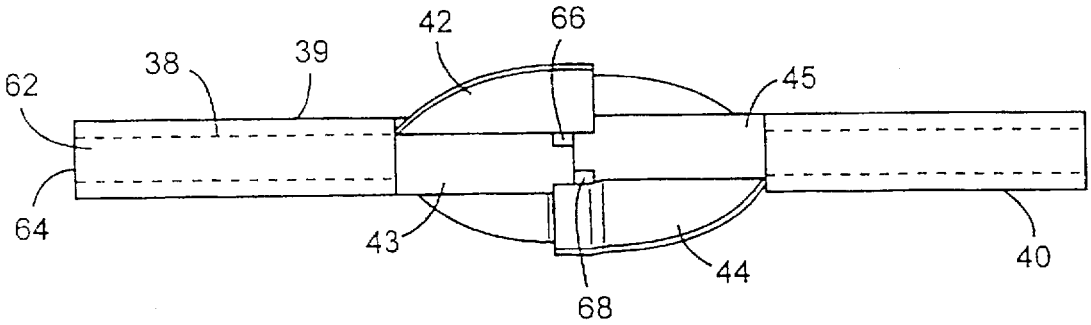
FIG. 4 is a top view of a throttle valve assembly according to the present invention.
Figure 12:
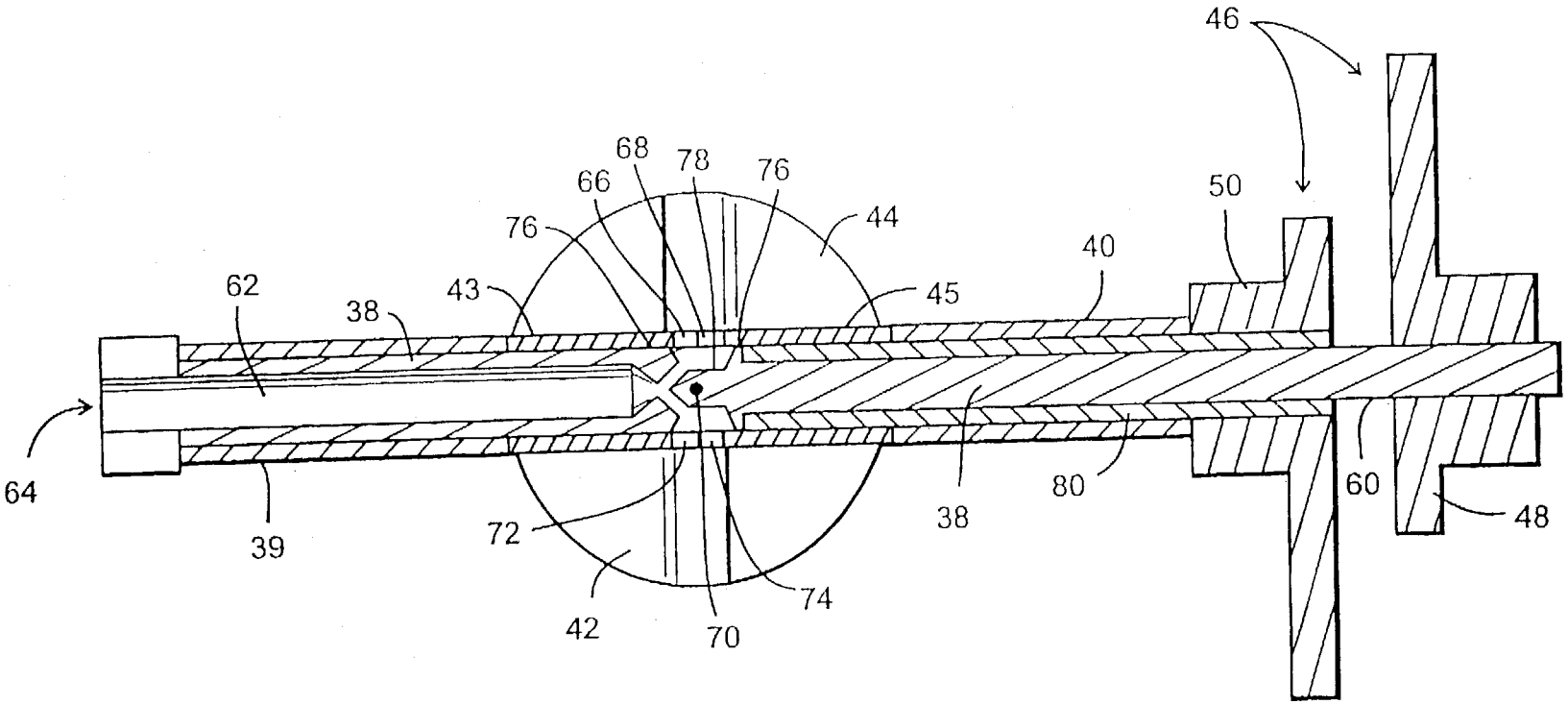
FIG. 12 is a cross-sectional view of the throttle valve assembly.

In contrast, with a view to FIGS. 2, 4, and 12, throttle valve assembly 24 generally includes a first rod 38, a first sleeve 39, a second sleeve 40, a first vane 42 mounted on a third sleeve 43, a second vane 44 mounted on a fourth sleeve 45, and an actuating mechanism 46. First rod 38 communicates with second sleeve 40, and actuating mechanism 46 is configured to regulate rotation of first rod 38, first sleeve 39, and third sleeve 43 as a single unit, and second sleeve 40, fourth sleeve 45, and an inner sleeve 80 as single unit. Inner sleeve 80 fits loosely on first rod 38, while second sleeve 40 and fourth sleeve 45 fit snugly against inner sleeve 80.

First vane 42 is coupled to third sleeve 43, and second vane 44 is coupled to fourth sleeve 45. Third sleeve 43 and first sleeve 39 fit tightly on rod 38, thereby turning when rod 38 turned by actuating mechanism 46. Second vane 44 is coupled to fourth sleeve 45, and it and second sleeve 40 ride snugly on inner sleeve 80.

First vane 42 and second vane 44 respond to the rotation of first rod 38 and inner sleeve 80, respectively. Vanes 42, 44 preferably rotate in opposite directions as the throttle setting of the engine is varied.

Figure 6:
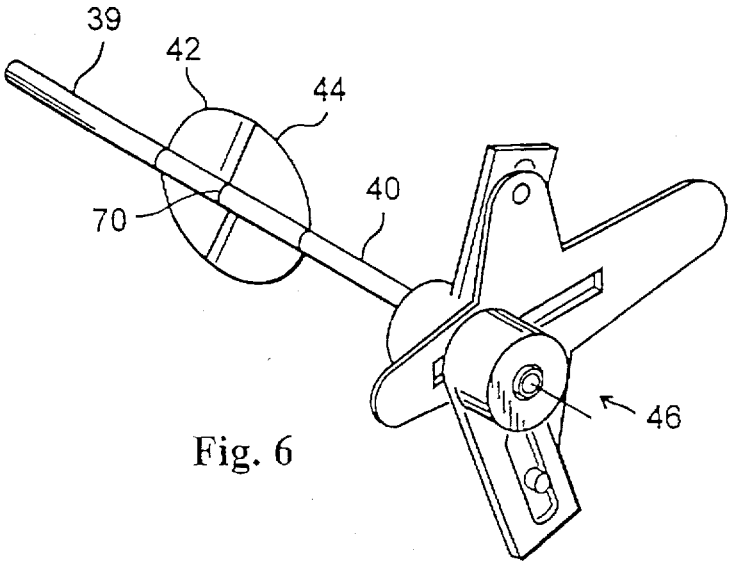
FIG. 6 is a perspective view of the throttle valve assembly in a closed position.
Figure 7:
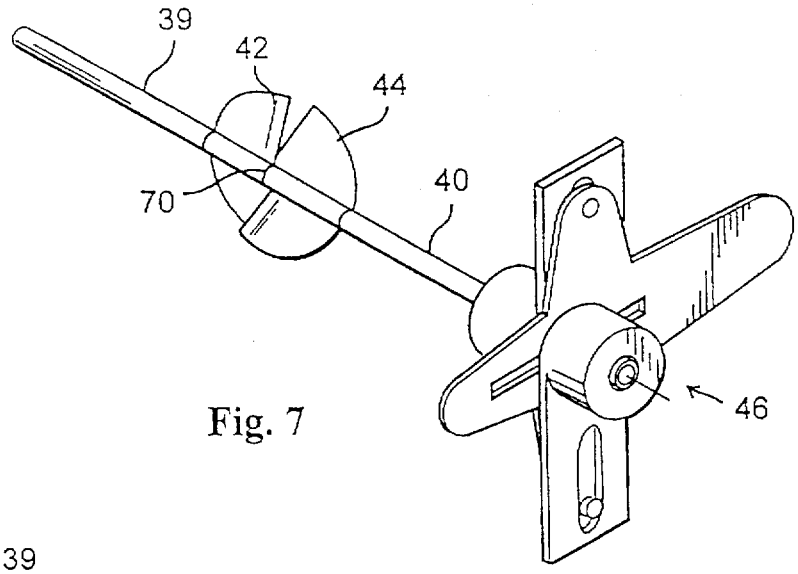
FIG. 7 is a perspective view of the throttle valve assembly in an partially open position.
Figure 8:
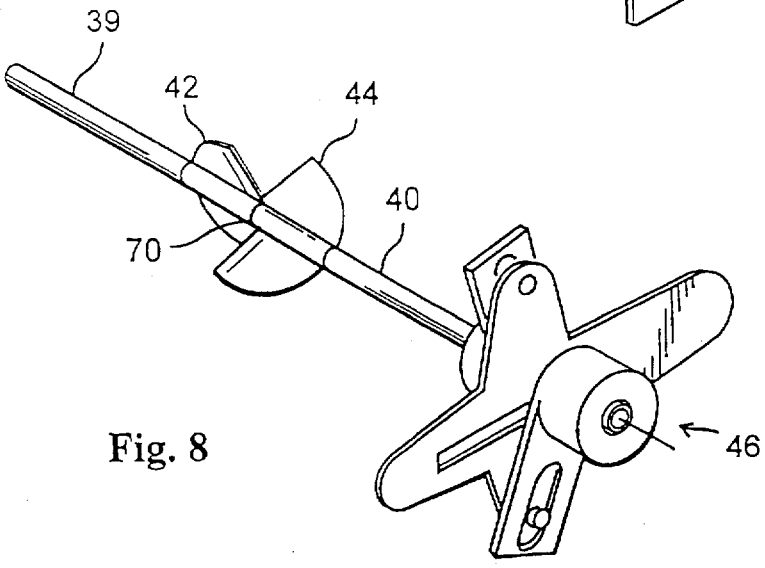
FIG. 8 is a perspective view of the throttle valve assembly in a fully open position.
Figure 9:
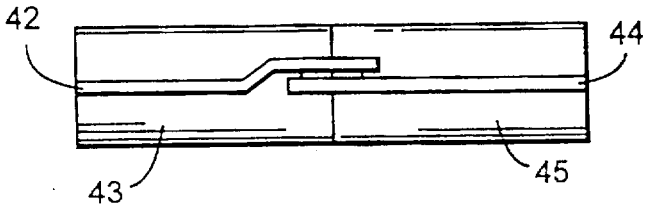
FIG. 9 is a top view of the throttle valve assembly in a closed position.

As described above, throttle valve assembly 24 is variable between a fully closed position, shown in FIG. 6,9, and a fully open position, shown in FIG. 4,8. FIG. 7 shows throttle valve assembly 24 in a partially open position. To reduce the amount of blow-by when throttle valve assembly 24 is in the fully closed position, vanes 42, 44 are configured to partially overlap each other. As shown in FIG. 9, when throttle valve assembly 24 is in the fully closed position, first vane 42 overlaps second vane 44 at the top and is overlapped by second vane 44 at the bottom.

Vanes 42, 44 induce a vortex in the air stream as it flows past throttle valve assembly 24. The velocity of the vortex, i.e., how fast the air/fuel mixture swirls, is inversely proportional to the amount that vanes 42, 44 are open. For example, when throttle valve assembly 24 is in the fully open position (shown in FIG. 4,8), the turbulence or vortex created by vanes 42, 44 is minimal. However, when throttle valve assembly 24 is at a low throttle setting (shown in FIG. 7), the vortex induced by vanes 42, 44 is appreciable. The higher vortex effect at lower throttle settings creates a homogenized air/fuel mixture, which is efficiently burned by the engine. When used in combination with fuel vaporizer 14 and fuel regulator 16 (see FIG. 1), the air/fuel mixture may be preferably adjusted to be as lean as necessary for fuel-efficient operation.

Figure 5:
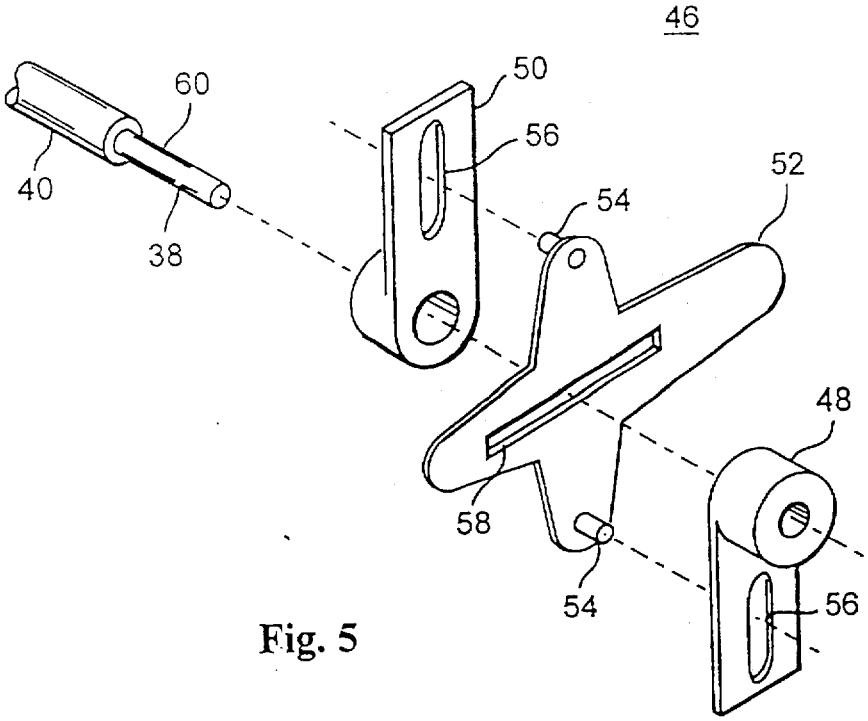
FIG. 5 is an exploded perspective view of an actuating mechanism according to the present invention.

Actuating mechanism 46 (see FIG. 5) regulates the opening and closing of vanes 42, 44, via rod 38, and inner sleeve 80. FIG. 5 depicts an exemplary version of actuating mechanism 46 utilized by the preferred embodiment. Of course, those skilled in this art will recognize that actuating mechanism 46 may be realized in any number of configurations to be compatible with specific applications. In addition, actuating mechanism 46 may include a return spring (not shown) for normally biasing throttle valve assembly 24 in a fully closed position.

Actuating mechanism 46 includes a first linkage arm 48 coupled to first rod 38, a second linkage arm 50 coupled to second sleeve 40, and a connecting plate 52 coupled to linkage arms 48, 50. Actuating mechanism 46 is arranged such that translational movement of connecting plate 52 causes linkage arms 48, 50 to cooperatively rotate in opposite directions relative to one another. In other words, as connecting plate 52 moves back and forth, one linkage arm rotates clockwise while the other linkage arm rotates counterclockwise. To achieve this cooperative motion, connecting plate 52 includes pins 54 that engage with slots 56 formed within linkage arms 48, 50. To facilitate translational movement, connecting plate 52 also includes a slot 58 formed therein. In this embodiment, slot 58 slidably fits over a narrow segment 60 of first rod 38 (see FIG. 5).

According to the preferred embodiment, second sleeve 40 is a sleeve-like member that fits over narrow segment 60 (see FIG. 5) of first rod 38. This configuration allows first rod 38 to rotate independently of second sleeve 40. When throttle valve assembly 24 is installed in carburetor 12, the ends of rod 38 and second sleeve 40 extend outside of body 22 (see FIG. 2). In addition, the end of first rod 38 extends beyond the end of second sleeve 40. According to the preferred embodiment, second linkage arm 50 is attached to the end of second sleeve 40, and first linkage arm 48 is attached to the end of first rod 38. Connecting plate 52 is sandwiched between linkage arms 48, 50, and pins 54 are aligned with slots 56. First linkage arm 48 secures connecting plate 52 such that it slidably fits upon narrow segment 60 of first rod 38.

As described above, throttle valve assembly 24 may be configured to provide vaporized fuel to carburetor 12. As described above, the end 64 of first rod 38 preferably functions as fuel inlet 26. According to one aspect of the preferred embodiment, first rod 38 also includes a fuel passageway 62 formed axially therein (see FIG. 4). Fuel passageway 62 is in fluid communication with a first fuel outlet or vapor port 66 formed in third sleeve 43 and with a second fuel outlet or vapor port 68 formed in fourth sleeve 45. In this embodiment, fuel outlets 66, 68 are located approximately where vanes 42, 44 meet, i.e., near the center of outlet port 30 (see FIG. 2).

In the fully closed position, vanes 42, 44 form a substantially circular disk having a centerpoint 70 axially aligned with rods 38, and second sleeve 40 (see FIG. 12). Centerpoint 70 also corresponds to the center of outlet port 30 (see FIG. 2). Throttle valve assembly 24 is preferably adapted such that, when in an open position, vaporized fuel is released through fuel outlets 66, 68 into an area proximate centerpoint 70. Due to the vortex induced by vanes 42, 44 and the configuration of fuel outlets 66, 68, the fuel is released into an area substantially central to the vortex. The location of fuel outlets 66, 68 is desirable to provide the engine with a homogenized air/fuel mixture. As described above, at lower throttle settings the vortex spins faster, which increases the mixing effect.

Figure 10:
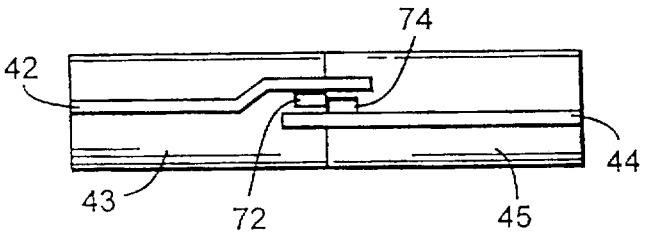
FIG. 10 is a top view of the throttle valve assembly in a partially open position.
Figure 11:
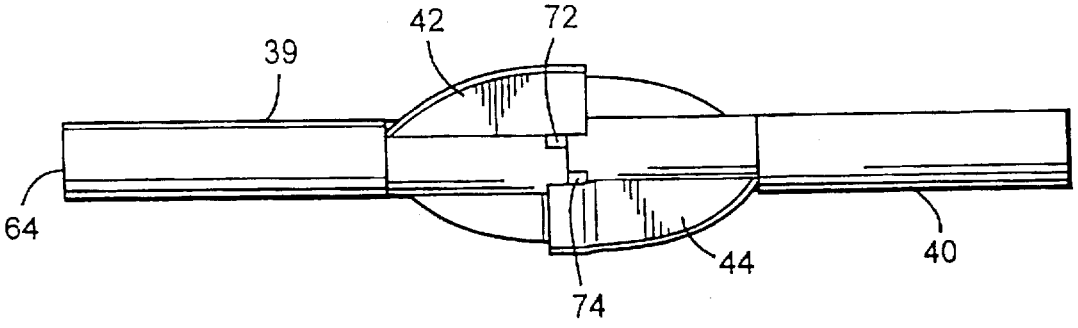
FIG. 11 is a bottom view of the throttle valve assembly in an open position.

FIGS. 9–11 show the vanes in each of a closed, semi-closed, and open position. FIG. 11 is a bottom view showing third and fourth vapor ports 72, 74. The positioning of vanes 42 and 44 regulate the amount of vortex created in vapor port 72, 74. The closer vane 42 is to vane 44 the greater the force of the vortex.

FIG. 12 is an cross-sectional view of the throttle valve assembly 24. Note that fuel vapor transverses fuel passage way 62. Fuel passage way 62 then splits and terminates at vapor ports 66, 68, 72, 74. First and second vapor ports 66, 68 are on the top portion and third and fourth 72, 74 vapor ports are on the bottom portion. Vanes 42, 44 are positioned on their respective vane carriers 43, 45 (which are third and fourth sleeves 43, 45) and rotate axially in opposition to one another.

In FIG. 12 rod 38 has a first diameter 76 for mounting first sleeeve 39, second sleeve 40, and vane carriers 43 and 45. Rod 38 had a second diameter 78 centrally located and less than first diameter 76. Vane carriers 43 and 45 abut proximate to second diameter 78 forming a hollow area. Vapor collects and exits through vapor ports 66, 68, 72, and 74. This is where the vortex is initiated.

In one preferred embodiment of the present invention vane carrier 43 is positioned stationary to rod 38. Vane carrier 40 rotates axially on rod 38. This configuration permits the opening and closing of vanes 42 and 44.

In another preferred embodiment of the present invention both vane carriers rotate about rod 38. This second configuration also permits the opening and closing of vanes 42 and 44.

In summary, a fuel delivery system 10 that utilizes an improved throttle valve assembly 24 is realized by the preferred embodiment of the present invention. The improved throttle valve assembly 24 functions to effectively homogenize the air/fuel mixture delivered to an internal combustion engine by creating a vortex in the induction air stream. In addition, the throttle valve assembly 24 compensates for the unsatisfactory operating efficiency of the internal combustion engine at lower throttle settings. Furthermore, a fuel delivery system 10 according to the present invention reduces fuel consumption and exhaust emissions when utilized with conventional internal combustion engines.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A throttle valve assembly for use with an internal combustion engine, said throttle valve assembly comprising:

a first vane carrier;

a first vane located on said vane carrier and positioned to regulate air flow proximate said throttle valve assembly;

a first vapor port in said first vane carrier, said first vapor port being positioned proximate said first vane;

a second vane carrier;

a second vane located on said second vane carrier and positioned to regulate air flow proximate said throttle valve assembly;

a second vapor port in said second vane carrier, said second vapor port being positioned proximate said second vane; wherein, said first and second vanes are adapted to respond to rotation of said first and second vane carriers; and said first and second vapor ports are configured to release fuel, thereby inducing turbulence in an air stream that flows perpendicular to said first and second vanes.

2. A throttle valve assembly as claimed in claim 1, wherein:

said first and second vapor ports are positioned between said first and second vanes; and said first and second vapor ports rotate apart from one another as said vanes approach an open position.

3. A throttle valve assembly as claimed in claim 2, wherein said first and second vane carriers are first and second sleeves, respectively, and said assembly additionally comprises:

a rod coaxially fitted to said first and second sleeves; and an inner sleeve coaxially fitted to said first and second sleeves and said rod.

4. A throttle valve assembly as claimed in claim 3, wherein:

said rod has a hollow portion in fluid communication with said first and second vapor ports.

5. A throttle valve assembly as claimed in claim 3, wherein:

said rod exhibits a first diameter and a second diameter, said second diameter being less than said first diameter; and said second diameter is centrally located forming a fuel reservoir between said rod and said first and second sleeves.

6. A fuel delivery system for use with an internal combustion engine, said system comprising:

fuel delivery means for providing a mixture of air and fuel to said internal combustion engine, said fuel delivery means comprising:

a body having an inlet port and an outlet port formed therein, and a throttle valve assembly having a first and a second vane configured to partially overlap one another in a closed position, said first and second vanes being adapted to regulate an air stream flowing from said inlet sort through said body and to induce turbulence in said air stream when said first and second vanes are in an open position, and said throttle valve further having a vapor port centrally located with respect to said first and second vanes; and a fuel vaporizer in fluid connection with said fuel delivery means, said fuel vaporizer being configured to provide said fuel delivery means with vaporized fuel to provide said mixture of air and fuel.

7. A fuel delivery system according to claim 6, wherein:

said first and second vanes are configured to induce a vortex in said air stream, said air stream flowing proximate said first and second vanes when said throttle valve assembly is in said open position; and said first and second vanes are adapted to be positioned variably between said closed and open positions.

8. A fuel delivery system according to claim 6, further comprising a fuel regulator adapted to regulate fluid characteristics of fuel delivered to said fuel vaporizer.

9. A fuel delivery system according to claim 8, further comprising an electronic control module adapted to control said fuel regulator.

10. A fuel delivery system according to claim 6, wherein said throttle valve assembly comprises:

a rod; and a vane carrier coaxially positioned with said rod, said first vane being attached to said vane carrier, and said first vane being located proximate said vapor port.

11. A fuel delivery system according to claim 10, wherein said vane carrier is a first vane carrier and said vapor port is a first vapor port, and said throttle valve additionally comprises: a second vane carrier coaxially positioned on said rod, said second vane being attached to said second vane carrier;

a second vapor port in said second vane carrier, said second vapor port being positioned proximate said second vane;

wherein, said first and second vanes are adapted to respond to rotation of said first and second vane carriers; and said first and second vapor ports are configured to release fuel, inducing turbulence in said air stream said air stream flowing substantially perpendicular to said first and second vanes.

12. A fuel delivery system according to claim 10, wherein:

said rod includes a fuel passageway formed therein; and said fuel passageway is in fluid communication with said vapor port and with said fuel vaporizer.

13. A fuel delivery system according to claim 6, further comprising:

a rod having said first vane coupled thereto; and a sleeve coaxially encompassing said rod, said sleeve having said second vane coupled thereto.

14. A fuel delivery system according to claim 13, further comprising an actuating mechanism configured to regulate rotation of said first and second vanes, said actuating mechanism comprising:

a first linkage arm coupled to said rod;

a second linkage arm coupled to said sleeve;

a connecting plate coupled to said first and second linkage arms; wherein translational movement of said connecting plate causes said first and second linkage arms to cooperatively rotate in opposite directions relative to one another causing said first and second vanes to cooperatively rotate in opposite directions relative to one another.

15. A throttle valve assembly for use with an internal combustion engine, said throttle valve assembly comprising:

a rod;

a first sleeve coaxially positioned to said rod;

a second sleeve coaxially positioned to said rod;

a first vane located on said first sleeve;

a second vane located on said second sleeve;

said first and second vanes positioned to regulate air flow proximate said throttle valve assembly;

a first and a second vapor port in said first sleeve, said first and second vapor ports being positioned proximate said first vane; and a third and a fourth vapor port in said second sleeve, said third and fourth vapor ports being positioned proximate said second vane.

16. A throttle valve assembly as claimed in claim 15, wherein:

said first and second vanes are adapted to be variable between a fully closed position and a fully open position; and a velocity of said vortex is inversely proportional to the amount that said first and second vanes are open.

17. A throttle valve assembly as claimed in claim 15, wherein:

said rod is configured to communicate fuel to said first, second, third, and fourth vapor ports.

18. A throttle valve assembly as claimed in claim 15, wherein:

said rod exhibits a first diameter and a second diameter, said second diameter being less than said first diameter;

said second diameter is centrally located, forming a fuel reservoir between said rod and said first and second sleeves, and said first and second sleeves abut proximate to said second diameter.

19. A throttle valve assembly as claimed in claim 16, wherein said first and second vanes are configured to induce a vortex in said air flow when said throttle valve assembly is in an open position.

* * * * *

UNITED STATES PATENT AND TRADEMARK OFFICE

CERTIFICATE OF CORRECTION

PATENT NO. : 5,753,147

DATED : 19 May 1998

INVENTOR(S) : Paul H. Hudz

It is certified that error appears in the above-indentified patent and that said Letters Patent is hereby corrected as shown below:

Column 7, Line 20: delete "sort" and insert --port-- therefor.

Column 7, Line 63, insert --, -- after the word stream.

Signed and Sealed this

Twenty-second Day of September, 1998

*Attest:*

Bruce Lehman

BRUCE LEHMAN

*Attesting Officer*

*Commissioner of Patents and Trademarks*